US009079085B2

(12) United States Patent
McBride et al.

(10) Patent No.: US 9,079,085 B2
(45) Date of Patent: Jul. 14, 2015

(54) PULL-UP BAR WITH HAND AND FINGER HOLDS

(71) Applicant: Stamina Products, Inc., Springfield, MO (US)

(72) Inventors: Robert McBride, Springfield, MO (US); Tyler Rogers, Springfield, MO (US); Taylor McBride, Springfield, MO (US); Siz-Pin Lin, Taichung (TW)

(73) Assignee: STAMINA PRODUCTS, INC., Springfield, MO (US)

( * ) Notice: Subject to any disclaimer, the term of this patent is extended or adjusted under 35 U.S.C. 154(b) by 202 days.

(21) Appl. No.: 13/759,819

(22) Filed: Feb. 5, 2013

(65) Prior Publication Data

US 2014/0221163 A1 Aug. 7, 2014

(51) Int. Cl.

| | |
|---|---|
| ***A63B 69/00*** | (2006.01) |
| ***A63B 21/16*** | (2006.01) |
| ***A63B 23/12*** | (2006.01) |
| ***A63B 21/068*** | (2006.01) |
| ***A63B 21/00*** | (2006.01) |
| ***A63B 23/16*** | (2006.01) |

(52) U.S. Cl.

CPC ..... *A63B 69/0048* (2013.01); *A63B 21/00047* (2013.01); *A63B 21/068* (2013.01); *A63B 21/1469* (2013.01); *A63B 21/1636* (2013.01); *A63B 23/1218* (2013.01); *A63B 23/16* (2013.01)

(58) Field of Classification Search

USPC ..... 482/38–43

See application file for complete search history.

(56) References Cited

U.S. PATENT DOCUMENTS

| | | | | |
|---|---|---|---|---|
| 3,915,452 | A * | 10/1975 | Winblad | 482/40 |
| D348,706 | S * | 7/1994 | Harrell | D21/691 |
| 5,417,628 | A * | 5/1995 | Vanderbleek | 482/40 |
| 5,543,185 | A | 8/1996 | Christensen | |
| 6,179,748 | B1 * | 1/2001 | Barr | 482/40 |
| 6,220,988 | B1 | 4/2001 | Williams | |
| 6,508,743 | B1 * | 1/2003 | Fortin | 482/41 |
| 6,709,365 | B2 | 3/2004 | Zeilinger | |
| 7,066,866 | B1 * | 6/2006 | Mobley | 482/40 |
| 7,204,790 | B2 | 4/2007 | Sleamaker | |
| 7,524,269 | B2 | 4/2009 | Postma et al. | |
| 7,540,831 | B2 | 6/2009 | Hauser et al. | |
| 7,601,100 | B1 * | 10/2009 | Hinds et al. | 482/40 |
| 7,621,847 | B2 * | 11/2009 | Lamle et al. | 482/40 |
| 7,651,443 | B1 | 1/2010 | Fenster et al. | |

(Continued)

FOREIGN PATENT DOCUMENTS

FR 2552997 A1 4/1985

*Primary Examiner* — Stephen Crow

(74) *Attorney, Agent, or Firm* — Pillsbury Winthrop Shaw Pittman LLP

(57) ABSTRACT

An exercise apparatus includes a doorway engaging portion configured to releasably secure the exercise apparatus in a doorway and distribute a weight of a user of the exercise apparatus through a frame of the doorway. The exercise apparatus also includes a finger hold mounted to the doorway engaging portion, the finger hold comprising a ridge or groove shaped and sized to receive the fingertips of the user. When the doorway engaging portion is releasably securing the exercise apparatus in the doorway, the user may insert the fingertips around the ridge or into the groove of the finger hold, and perform an exercise by supporting an entirety of the weight of the user through the frame of the doorway via the finger hold. A method of exercising using an exercise device having a doorway engaging portion and a finger hold configured to receive the fingertips of a user, is also disclosed.

24 Claims, 8 Drawing Sheets

(56) References Cited

U.S. PATENT DOCUMENTS

| | | | | |
|---|---|---|---|---|
| 7,871,049 | B2 | 1/2011 | Fontana et al. | |
| D633,156 | S * | 2/2011 | Caswell et al. | D21/679 |
| D633,961 | S * | 3/2011 | Loew et al. | D21/679 |
| 8,100,814 | B2 * | 1/2012 | Van Raalte et al. | 482/35 |
| 8,206,273 | B2 * | 6/2012 | Skipper | 482/96 |
| D667,901 | S * | 9/2012 | Garcia Chavez | D21/679 |
| 2005/0250619 | A1 * | 11/2005 | Daikeler et al. | 482/40 |
| 2006/0079380 | A1 | 4/2006 | Wells | |
| 2013/0184124 | A1 * | 7/2013 | Reed | 482/37 |

* cited by examiner

PULL-UP BAR WITH HAND AND FINGER HOLDS

FIELD

The present disclosure relates to the field of exercise equipment, and more in particular to an exercise device configured to provide a workout for the arms of a user.

BACKGROUND

In order to promote good health and physical well-being, many individuals engage in physical exercise. It is common for individuals who are engaging in physical activities to employ the use of exercise devices to assist in performing exercises. One type of exercise device is a pull-up bar, which is an elevated bar structure configured to support the body weight of a user through the arms of the user, such that a user may lift his body weight by pulling on the elevated bar structure. Some pull-up bars are designed to be removably supported in a doorway, allowing for temporary placement for the duration of the exercise.

SUMMARY

According to an embodiment, an exercise apparatus includes a doorway engaging portion configured to releasably secure the exercise apparatus in a doorway and distribute a weight of a user of the exercise apparatus through a frame of the doorway. The exercise apparatus also includes a finger hold mounted to the doorway engaging portion, the finger hold comprising a ridge or groove shaped and sized to receive the fingertips of the user. When the doorway engaging portion is releasably securing the exercise apparatus in the doorway, the user may insert the fingertips around the ridge or into the groove of the finger hold, and perform an exercise by supporting an entirety of the weight of the user through the frame of the doorway via the finger hold.

According to another embodiment, a method of exercising using an exercise device is provided. The exercise device includes a doorway engaging portion configured to releasably secure the exercise apparatus in a doorway and distribute a weight of a user of the exercise apparatus through a frame of the doorway. The exercise device also includes a finger hold mounted to the doorway engaging portion, the finger hold comprising a ridge or groove shaped and sized to receive the fingertips of the user. The method includes supporting the exercise apparatus in the doorway via the doorway engaging portion. The method also includes inserting the fingertips of the user around the ridge or into the groove of the finger hold. The method further includes supporting an entirety of the weight of the user through the finger hold to exercise an arm of the user.

These and other objects, features, and characteristics of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment, the structural components illustrated herein can be considered drawn to scale. It is to be expressly understood, however, that the drawings are for the purpose of illustration and description only and are not a limitation. In addition, it should be appreciated that structural features shown or described in any one embodiment herein can be used in other embodiments as well. It is to be expressly understood, however, that the drawings are for the purpose of illustration and description only. As used in the specification and in the claims, the singular form of "a", "an", and "the" include plural referents unless the context clearly dictates otherwise.

BRIEF DESCRIPTION OF THE DRAWINGS

Features of the disclosure are shown in the drawings, in which like reference numerals designate like elements. The drawings form part of this original disclosure in which.

DETAILED DESCRIPTION OF THE ILLUSTRATED EMBODIMENTS

Figure 1:
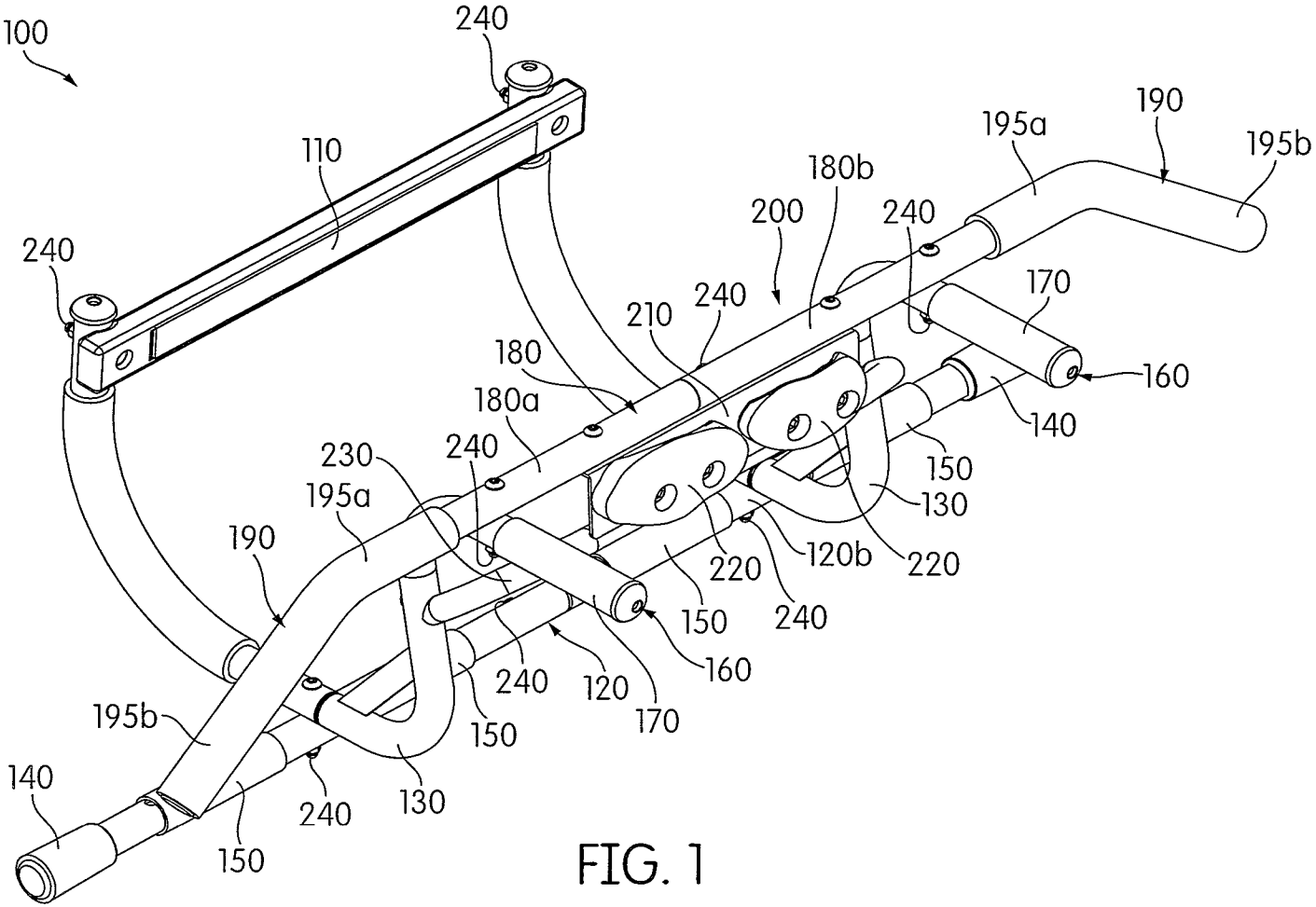
FIG. 1 illustrates an embodiment of a pull-up bar assembly having finger holds.

FIG. 1 illustrates an embodiment of a pull-up bar assembly 100, configured to be removably supported in a doorway. Specifically, the pull-up bar assembly 100 may be supported on the door frame, and the structures appurtenant and adjacent thereto. In an embodiment, the pull-up bar assembly 110 includes a doorway engaging portion configured to support the pull-up bar assembly 110 in a doorway. As shown, the pull-up bar assembly 100 includes a lintel engaging portion 110, which may be received on the upper portion (e.g., lintel) of the door casing (e.g., the molding surrounding the doorway). Spaced from the lintel engaging portion 110 may be a transverse bar 120, configured to extend across the side portions of the door casing, adjacent to the door jambs. It may be appreciated that the lintel engaging portion 110 and the transverse bar 120 may be separated from one another in orthogonal directions (e.g., horizontally and vertically), so that the lintel engaging portion 110 may pass through the opening of the doorway to engage the upper portion of the door casing on a first side of the doorway, while the transverse bar 120 extends across the doorway, contacting the side portions of the door casing, on a second side of the doorway.

In the illustrated embodiment, the lintel engaging portion 110 and the transverse bar 120 are coupled by a pair of side bars 130. It may be appreciated that in some embodiments the pair of side bars 130 may be spaced to distribute the forces associated with supporting the weight of the pull-up bar assembly and the user across the length of the lintel engaging portion 110. In an embodiment, a single support bar may be of sufficient strength to couple the lintel engaging portion 110 and the transverse bar 120. In some such embodiments, the single support bar may be centered relative to the lintel engaging portion 110 and the transverse bar 120, or may otherwise be configured for balancing forces throughout, so as to prevent disengagement between the pull-up bar assembly 100 and the doorway due to an unbalanced load when the user is engaging in an exercise. Such balancing of loads may also be achieved utilizing the pair of side bars 130, as shown. As shown in the illustrated embodiment, the side bars 130 may extend down from where the lintel engaging portion 110 would rest on the lintel of the door casing, and extend through the doorway, coupling to the transverse bar 120. It may be appreciated that the transverse bar 120 may press against the side portions of the door casing when the body weight of a user is exerted on the pull-up bar assembly 100, which may counteract any tendency of the lintel engaging portion 110 to pivot away from the lintel of the door casing. As such, the pull-up bar assembly 100 may generally be stable when positioned on the door casing, facilitating a user to conduct pull-up exercises thereon.

As shown in the illustrated embodiment, in some embodiments the transverse bar 120 may include cushion members 140 that may provide a relatively softer surface to contact the door casing or surrounding wall. For example, in embodiments where the transverse bar 120 is formed of metal, it may be appreciated that having such metal in contact with the door casing may scuff or otherwise damage the door casing. The risk of such damage may be increased due to frictional rubbing or pressure induced stress associated with the weight of the user, and forces associated with the user engaging in the pull-up exercises. As such, in some embodiments the cushion members 140 may be sized or positioned to provide a buffer between the hard surface of transverse bar and the door casing or surrounding wall. In some embodiments, the cushion members 140 may be formed of a resilient material, such as foam, which may deform to distribute the forces associated with the user engaging in the exercise. In the illustrated embodiment, where the transverse bar 120 is of a generally tubular construction, the cushion members 140 may comprise end caps for the transverse bar 120, and may have a wider diameter that surrounds the tubular construction of the transverse bar at opposing ends thereof.

Having a configuration sufficient to support the weight of a user on the door casing, the pull-up bar assembly 100 may further include thereon one or more user engagements through which the user may grasp or otherwise engage to perform pull-up arm exercises. In some embodiments, such as that illustrated in FIG. 1, grips 150 may be positioned on the transverse bar 120, so as to provide surfaces that a user may grasp to perform the pull-up arm exercise. In the illustrated embodiment, with the tubular configuration of transverse bar 120, the grips 150 may surround the transverse bar 120 (e.g., having a toroid configuration). In some embodiments, the grips 150 may be spaced intermittently on the transverse bar 120. As shown in the illustrated embodiment, a pair of the grips 150 may be positioned between the side bars 130, while a pair of the grips 150 may be positioned outside of the side bars 130, adjacent to the cushion members 140. Such spacing may be configured to encourage pull-up arm exercises of different hand spacings. For example, engaging the grips 150 positioned outside of the side bars 130 (with the user's palms facing towards the user) may facilitate a pull-up exercise for the biceps, while engaging the grips 150 positioned between the side bars 130 (with the user's palms facing away from the user) may facilitate a pull-up exercise for the triceps. Other positions of grips 150 are additionally or alternatively possible, as described in greater detail below. Further, it may be appreciated that while in the illustrated embodiment the grips 150 surround the rigid structure of the transverse bar 120, in other embodiments the grips 150 may be molded into the transverse bar 120, or other structural members of the pull-up bar assembly 100.

As shown in FIG. 1, the side bars 130 may be configured to extend away from both the lintel engaging portion 110 and the transverse bar 120, and may support further structures for engagement by the user. For example, in the illustrated embodiment the side bars 130 may be shaped so as to extend upward relative to the doorway, so as to provide gripping surfaces configured for a greater initial reach of the user. In an embodiment, ends 160 of the side bars 130, distal from the lintel engaging portion 110, may extend outwards away from the lintel engaging portion 110, however may be generally level with the lintel engaging portion 110. In an embodiment, such a configuration may cause the ends 160 of the side bars 130 to vertically extend generally at a height of the doorway onto which the pull-up bar assembly 100 is secured. As shown, in an embodiment end grips 170 may be placed on the side bars 130, which may provide a user engagement for the user to engage in pull-up exercises where the user's palms generally face towards one another or away from one another. In an embodiment, the end grips 170 may be configured to cap the side bars 130 (e.g., may form a pocket that surrounds the ends 160, such as the cushion members 140 on the transverse bar 120). In some embodiments, the end grips 170 may be similar to the grips 150, and may have a toroid configuration. In some such embodiments, a separate end cap may be positioned at the ends 160.

FIG. 1 further illustrates a raised transverse bar 180, extending across the side bars 130 proximal to the end grips 170. It may be appreciated that the raised transverse bar 180 may be configured to provide support grips at a greater height than the grips 150. In some embodiments, including the illustrated embodiment, the raised transverse bar 180 may include angled ends 190, which may be covered with angled grips 195 to provide user engagement surfaces that are not oriented horizontally relative to the doorway and floor, on which the user may perform pull-up exercises. In an embodiment, the angled grips 195 may include horizontal grip portions **195*a* that extend into angled grip portions 195*b*, such as is illustrated in FIG. 1. It may be appreciated that a user of the pull-up bar assembly 100 may perform exercises by pulling up on either the horizontal grip portions 195*a* or the angled grip portions 195*b***, with the palms either facing towards or away from the user, depending on the muscles to be exercised.

Further included on the pull-up bar assembly 100 is a finger hold assembly 200. As described in greater detail below, the finger hold assembly 200 may be configured to provide one or more rock climbing simulation surfaces, which may be engaged by the tips of a user's fingers to simulate climbing, and supporting oneself utilizing one's fingers instead of one's palms. In some embodiments, such as the illustrated embodiment, the finger hold assembly 200 may include a support plate 210. The support plate 210 may be oriented with a generally planar surface thereof extending vertically (e.g., parallel with the doorway), so as to receive one or more finger holds 220, described in greater detail below, thereon. In some embodiments, such as that illustrated, the support plate 210 may be mounted to the raised transverse bar 180. While in the illustrated embodiment the support plate 210 extends downwards from the raised transverse bar 180, in some embodiments the support plate 210 may extend upwards from the raised transverse bar 180, or may extend both upwards and downwards from the raised transverse bar 180. In some embodiments, the support plate 210 may further be supported by a finger hold support bar 230. As shown, the finger hold support bar 230 may extend, outward to the support plate 210 from the side bars 130, and may provide further structural stability for the support plate 210, so as to prevent bending or other deformation of the support plate 210 when a user's weight is supported on the finger holds 220. In the illustrated embodiment, where the finger holds 220 are configured to extend forward of the doorway that the pull-up bar assembly 100 is supported on, it may be appreciated that the finger hold support bar 230 may likewise extend forward from the side bars 130, and may have a portion thereof that is generally aligned with the raised transverse bar 180, so as to allow for planar mounting of the support plate 210 therebetween.

It may be appreciated that other mounting configurations for the support plate 210 and/or the finger holds 220 are additionally or alternatively possible. For example, the finger holds 220 may be configured (either through their own construction, or from their mounting on the support plate 210) to be angled relative to vertical. For example, in an embodiment one or more of the finger holds 220 may be generally angled between vertical and horizontal, so as to simulate climbing up an outwardly sloped overhang (e.g., climbing undercling). It may also be appreciated that in some embodiments, finger holds 220 may additionally or alternatively be mounted elsewhere on the pull-up bar assembly 100 (e.g., directly to the side bars 130, the transverse bar 120, and/or the raised transverse bar 180).

The constituent members and pieces of the pull-up bar assembly 100 may be of any appropriate construction or configuration. For example, while in some embodiments the rigid support structures of the pull-up bar assembly 100 described above may be generally of integral construction, in the illustrated embodiment some of the components are themselves assemblies. In an embodiment, connecting apertures associated with separable components of the pull-up bar assembly 100 may be configured to receive connecting fasteners, such as screws, bolts, or other connecting members. Although in some embodiments the pieces and members are connected by removable fasteners such that the pieces and members are detachable for ease of packaging or other space-saving storage, in other embodiments the pull-up bar assembly 100 may be solid, or the pieces or members may be permanently fastened to one another, through welding, one-way fasteners, or so on. Other mechanisms for securing portions of the pull-up bar assembly 100 together are additionally or alternatively possible, including but not limited to welding, snap fitting, integral molding, and adhesion.

In the embodiment of FIG. 1, fasteners 240 (including, for example, nuts and bolts) may be utilized to secure portions of the pull-up bar assembly 100 described above to each other, or to assemble constituent parts into the portions of the pull-up bar assembly 100. In the illustrated embodiment, for example, a fastener 240 may be utilized to secure a first portion 120*a* of the transverse bar 120 to a second portion 120*b* of the transverse bar 120. Fasteners 240 are further shown in FIG. 1 as coupling the side bars 130 to the lintel engaging portion 110, coupling the transverse bar 120 to the side bars 130, coupling the raised transverse bar 180 to the side bars 130, and coupling a first portion 180*a* of the raised transverse bar 180 to a second portion 180*b* of the raised transverse bar 180.

As shown, components of the pull-up bar assembly 100 may be of a tubular construction. With such a configuration, a portion of one member may be shaped to be received in a portion of another member. For example, in the illustrated embodiment the transverse bar 120 comprises a tubular construction, configured so that an end of the second portion 120*b* is received within an end of the first portion 120*a*, so that the fastener 240 may extend through both the first portion 120*a* and the second portion 120*b* therein to form the transverse bar 120. Other components of the pull-up bar assembly 100 are similarly coupled. Although the use of shaped tubes is desirable due to their structural strength and ease of manufacture, other configurations of the pieces and members may be used to form the pieces and members of the pull-up bar assembly 100. Furthermore, although in some embodiments various members of the pull-up bar assembly 100 may have a curved or circular cross section, while other members, such as the lintel-engaging portion 110, may have a rectangular cross section, other combinations of different shaped parts can be used. Accordingly, the illustrated generally tubular configuration of many of the component parts of the pull-up bar assembly 100 are also merely exemplary, and other shapes or configurations of the component parts and their assembly are additionally or alternatively possible. For example, to secure components that are not received within one another, apertures extending through each of the component parts may be aligned and joined with a longer fastener extending through both.

Regardless of the assembly of the components thereof, it may be appreciated that the rigid structures of the pull-up bar assembly 100 be of any appropriate material, including but not limited to being made of metal, wood, hard plastic, composite materials (such as epoxy coated carbon fiber material), or other material having sufficient durability to support the body weight of a user, and permit exercises while maintaining structural stability of pull-up bar assembly 100. Additionally, the softer materials of the pull-up bar assembly 100, including but not limited to the grips 150, the cushion members 140, the angled grips 195, end-caps, or other materials that may prevent scratching of the door casing or wall, or provide a cushioned gripping surface for the user, may be of any appropriate construction or configuration. For example, such members may comprise one or more of rubber, felt, cloth, plastic, or any other appropriate material.

In some embodiments, the grip materials may be formed from or contain an ergonomic material to enhance the ability of the user's hand to grasp the pull-up bar assembly 100. Examples of such an ergonomic material include a high friction material for enhanced grip and/or a spongy material to provide for a padded grip. In some embodiments, the grip materials (e.g., the grips 150 and the angled grips 195) may include finger grooves that may guide the user's fingers as the user wraps his fingers around the transverse bar 120 or the raised transverse bar 180.

It may be appreciated that when utilized as end caps (e.g., covering hollow openings at the ends of the rigid structures of the pull-up bar assembly 100), the softer materials such as those described above may provide impact cushioning, or may otherwise cover sharp or irregularly cut terminal portions of the rigid structures of the pull-up bar assembly 100. In some embodiments, one or more of the softer materials may be formed on or otherwise provided on the rigid structures prior to assembly of the rigid structures together. For example, the grips 150 may be provided to the user as mounted on the first portion 120*a* and the second portion 120*b*, while the user may subsequently couple the first portion 120*a* to the second portion 120*b* to form the transverse bar 120 during assembly.

Figure 2:
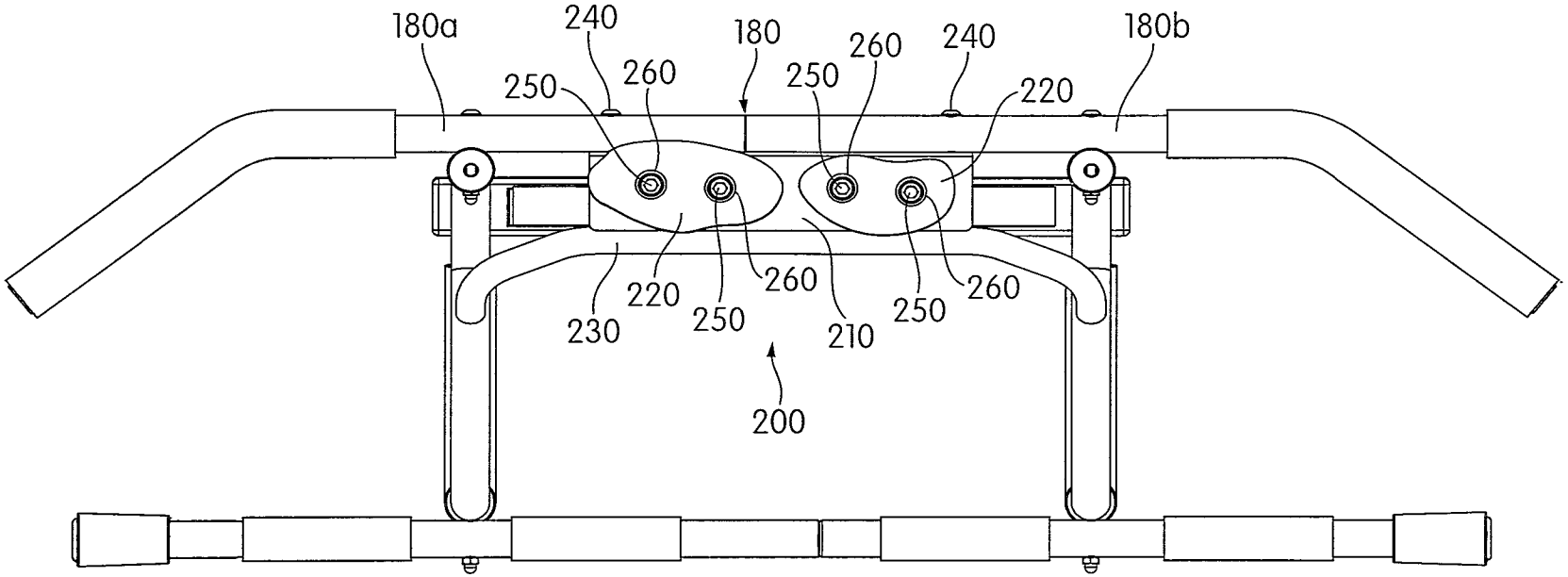
FIG. 2 illustrates an enlarged view of a finger hold assembly of the pull-up bar assembly.

FIG. 2 illustrates an enlarged view of the finger hold assembly 200 of the pull-up bar assembly 100. As shown, the support plate 210 may be supported between the raised transverse bar 180 and the finger hold support bar 230. While in some embodiments the support plate may be coupled to the raised transverse bar 180 and/or the finger hold support bar 230 by fasteners, in other embodiments the support plate 210 may be welded or may otherwise be secured, such as through those mechanisms described above. In an embodiment, the support plate 210 may be integral with the finger hold support bar 230. In another embodiment, the support plate 210 may be fixed to the raised transverse bar 180 or another portion of the pull-up bar assembly 100, and may non-fixedly rest against the finger hold support bar 230, such that the finger hold support bar 230 simply provides additional structural support to buttress the support plate 210 to prevent bending or other deformation thereof during the pull-up exercises utilizing the finger holds 220.

In the embodiment illustrated in FIG. 2, the finger holds 220 comprise climbing holds having one or more of ridges or grooves formed therein shaped and sized to receive the fingertips of the user. In some embodiments, the finger holds 220 may be secured to the support plate 210 by one or more fasteners 250. While in some embodiments the fasteners 250 associated with the finger holds 220 may generally be of the same configuration as the fasteners 240 utilized in assembling the remainder of the pull-up bar assembly 100, in the illustrated embodiment the fasteners 250 are larger (e.g., thicker), which may facilitate transfer of a great amount of force from the weight of the user applied therethrough from the finger holds 220 to the remainder of the pull-up bar assembly 100. As shown, in an embodiment there may be a plurality of fasteners 250 driven into and/or through associated apertures 260 in each finger hold 220. In the illustrated embodiment, the fasteners 250 are driven through the finger hold 220, then through the support plate 210, and may be secured by a bolt or similar securing member on the opposite side of the support plate 210. In other embodiments, one or more apertures may extend partially through the finger holds 220, with an opening of the aperture(s) formed in a face of the finger hold 220 that contacts the support plate 210. As such, fasteners (such as the fasteners 250) may be inserted through associated apertures the support plate 210 and may be received in the finger holds 220. In some embodiments, each aperture 260 in the finger hold 220 might not extend completely through the finger hold 220 (e.g., might extend only partially into the finger hold 220). In an embodiment, each aperture 260 may itself contain threading configured to receive a threaded configuration of the fastener 250, to allow for securing of the fastener 250 therein. In other embodiments, such as embodiments where the apertures 260 extend completely through the finger hold 220, the aperture 260 may have a generally smooth interior surface, and may be configured to allow for passage of the fastener 250 therethrough, to be secured by a nut or other securing member. In some embodiments, the fastener being received in the finger holds 220 may be configured for manual tightening or loosening by hand, instead of being configured for tightening or loosening via a tool.

Figure 3:
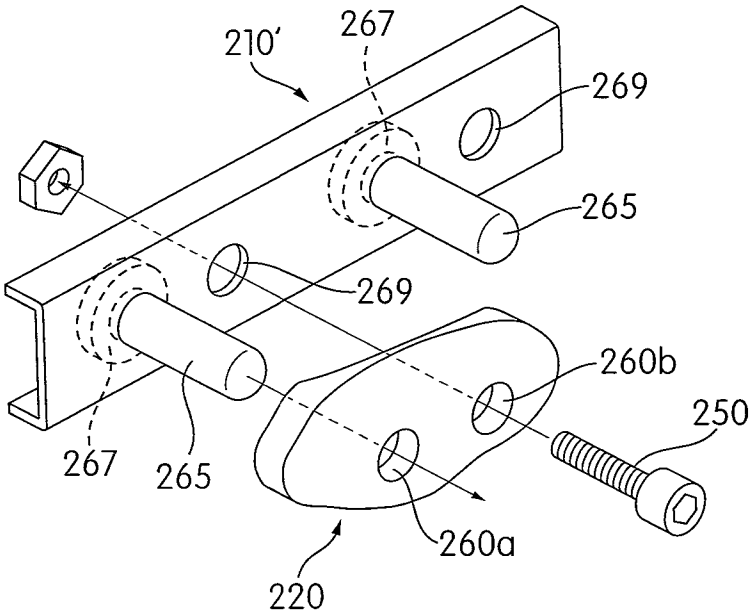
FIG. 3 illustrates another embodiment of a finger hold assembly.

It may be appreciated that in some embodiments, the support plate 210 may be shaped or otherwise configured to receive each finger hold 220. For example, as shown in FIG. 3, a support plate 210' may be configured with one or more protruding pins 265 configured to engage one of the apertures 260 in the finger hold 220. The protruding pins 265 may be integrally formed with, welded, or otherwise permanently attached to the support plate 210', so that removal of the finger hold 220 may be accomplished with removal of only a single removable fastener, such as the fastener 250. In an embodiment, such as that shown, the protruding pins 265 may be configured with a welding surface 267 that may be welded or otherwise permanently attached to a back side of the support plate 210'. In some embodiments, additional or alternative welding surfaces, or other features for permanently securing the protruding pins 265 to the support plate 210', may be formed on the support plate 210' and/or the protruding pin 265. As shown, in an embodiment the protruding pin 265 may be configured to extend through an aperture 260*a* when the finger hold 220 is moved onto the support plate 210'. Where the fastener 250 comprises a threaded bolt 250*a* and associated nut 250*b*, the threaded bolt may be placed through an aperture 260*b* in the finger hold 220, and extend through an associated aperture 269 on the support plate, before being received by the nut 250*b*. Such an engagement between the finger holds 220 and the support plate 210' (or other embodiments of the support plate 210) is merely exemplary, and other engagements are additionally or alternatively possible across various embodiments.

It may be appreciated that the finger holds 220 may be of any appropriate construction or configuration as well. For example, in some embodiments the finger holds 220 may be formed of or otherwise comprise fiberglass, urethane, resin, metal, wood, rock, plastic, or any other appropriate material. In some embodiments, the finger holds 220 may be shaped with grooves therein and/or ridges around the perimeter thereof, to provide finger graspable surfaces. In other embodiments, the finger holds 220 may comprise protruding surfaces or generally irregularly shaped ledges simulating rocky outcroppings from which the user may support their body weight and conduct pull-up exercises. It may further be appreciated that while in the illustrated embodiment a pair of finger holds 220 are mounted to the pull-up bar assembly 100, in other embodiments a single finger hold 220, or additional finger holds 220, may be utilized. As shown, where multiple finger holds 220 are utilized, each may have the same configuration or a differing configuration.

Figure 4:
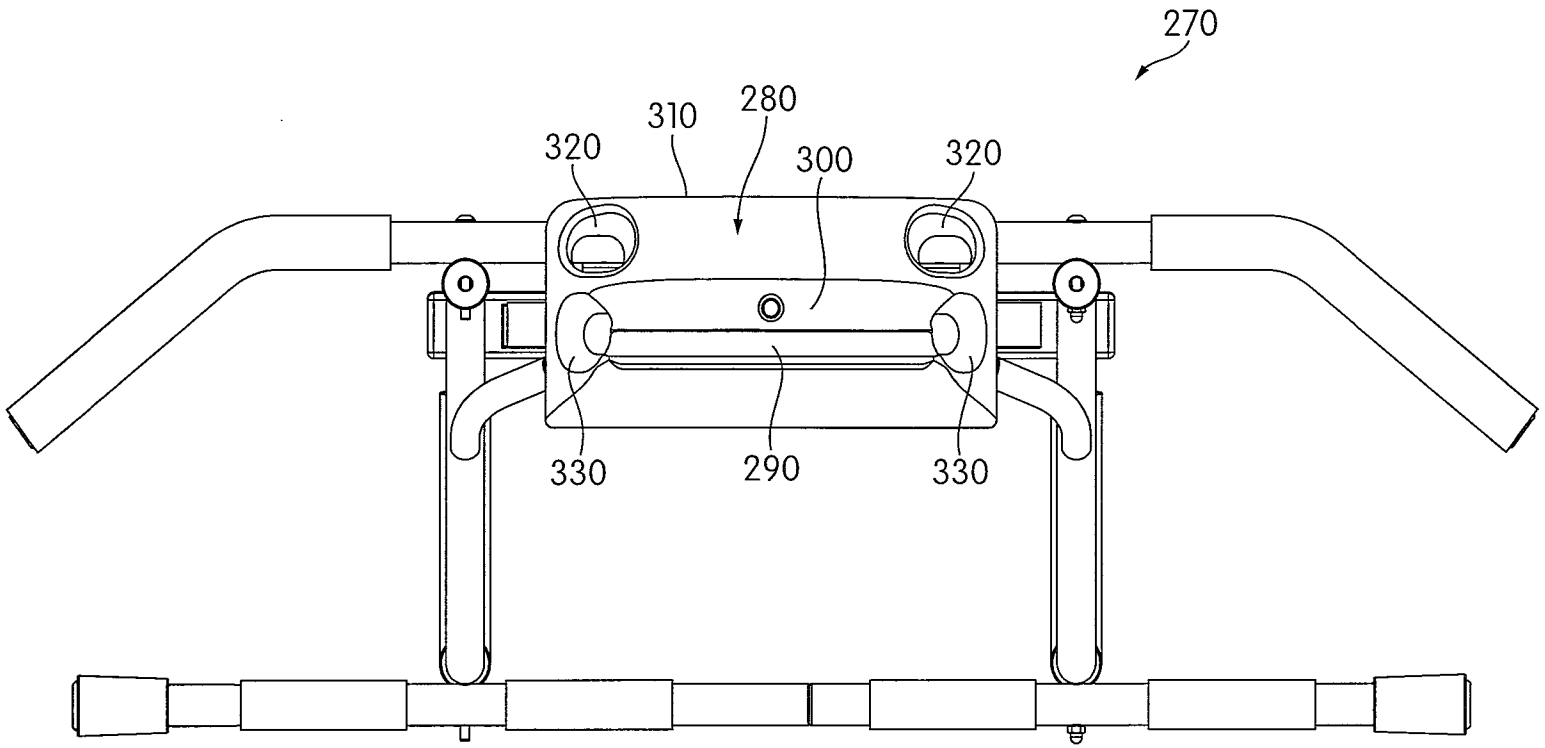
FIG. 4 illustrates another embodiment of a pull-up bar assembly having another embodiment of a finger hold assembly.
Figure 5A:
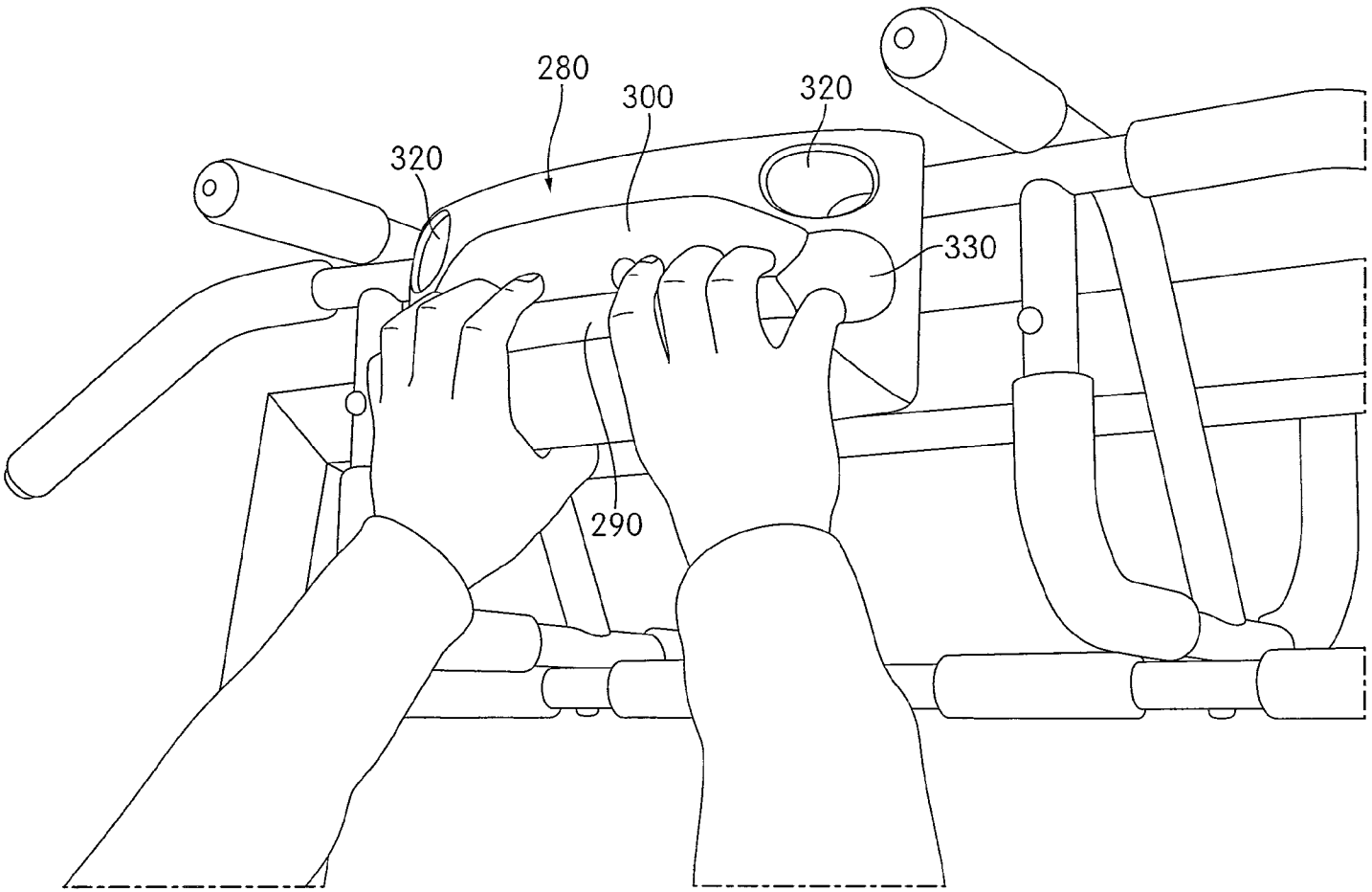
FIGS. 5A and 5B illustrate user engagement of the finger hold assembly of FIG. 3.
Figure 5B:
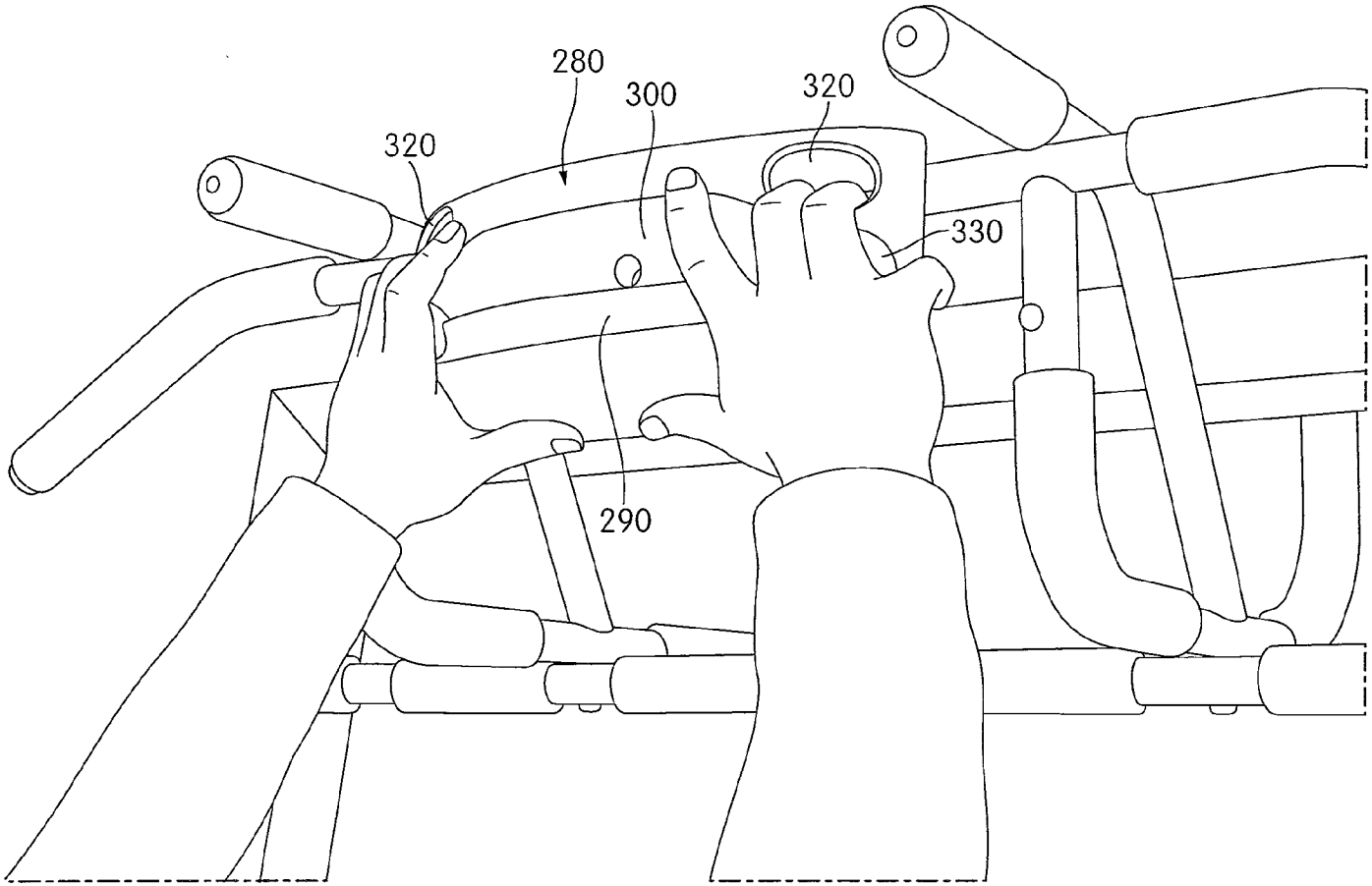
Figure 6:
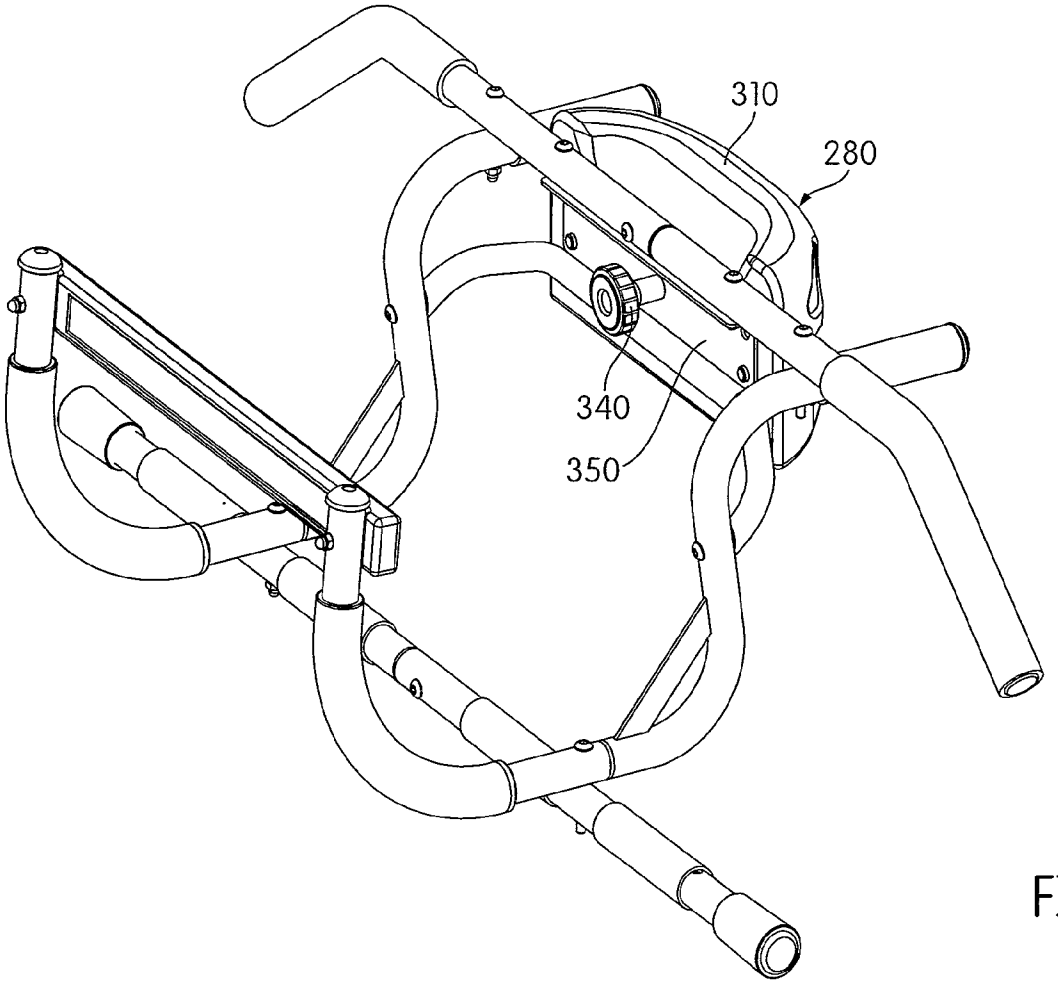
FIG. 6 illustrates a mounting engagement of the finger hold assembly of FIG. 4 to the remainder of the pull-up bar assembly.

FIG. 4 illustrates a pull-up bar assembly 270 with a finger hold 280 that has a different configuration from the finger holds 220. As shown, the finger hold 280 comprises multiple grooves and ridges therein to facilitate a user supporting his weight on the pull-up bar assembly 270 via his fingers. Specifically, the finger hold 280 includes a lower groove 290 and an upper groove 300 extending across the face thereof. In some embodiments a top surface 310 of the finger hold 280 may include a ridge to form an additional grasping surface. As shown, in some embodiments additional grasping apertures (e.g., upper apertures 320 and lower apertures 330) may be provided as additional grasping surfaces. In some embodiments, the grasping apertures 320, 330 may provide a smaller grasping surface as the grooves 290, 300, and may be configured to receive a subset of the average user's fingers, instead of providing a surface large enough to typically be engaged by all of the user's fingers. It may therefore be appreciated that a user of the pull-up bar assembly 270 may exercise by hanging from his fingers at the finger hold 280, and then move fingers among the grooves, ridges, and apertures formed on the finger hold 280, either while hanging, or while conducting a pull-up, as shown in FIGS. 5A and 5B. As shown in FIG. 6, in some embodiments a hand adjustable turnscrew 340 may be inserted through a support plate 350 of the pull-up bar assembly 270 (analogous to the support plate 210 of the pull-up bar assembly 100), and extend into the finger hold 280. The turnscrew 340 may therefore be removed by hand, to allow for removal and replacement of the finger hold 280. In some embodiments, multiple apertures may be formed in the support plate 350, so as to allow for multiple finger holds to be secured thereto, either alternatively, or together with one another, as in the finger hold assembly 200 of FIGS. 1 and 2.

Figure 7:
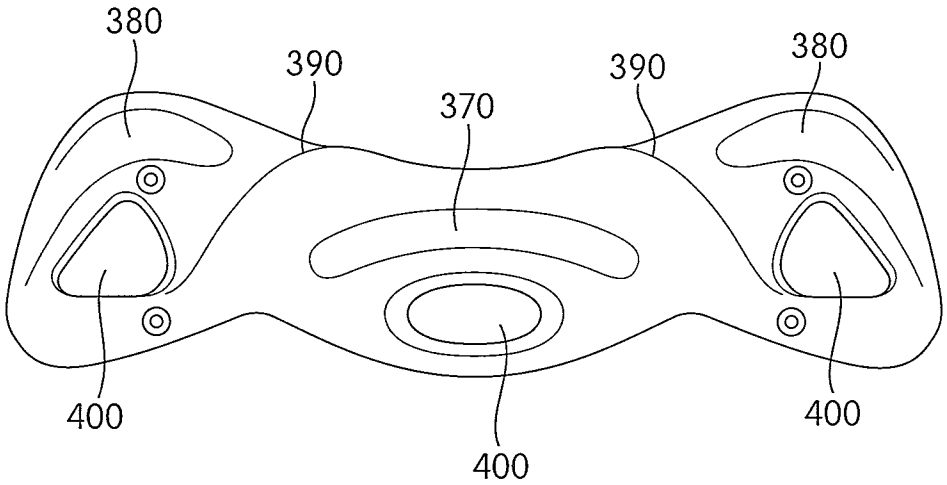
FIG. 7 illustrates another embodiment of a finger hold assembly.

FIG. 7 illustrates another embodiment of a finger hold, having generally curved grooves with portions thereof oriented at angles relative to horizontal. Specifically, finger hold 360 includes a central groove 370 that forms a generally curved path within the finger hold 360. Side grooves 380 also form curved paths, and are vertically offset from the central groove 370. Further, top ridges 390 are also curved relative to horizontal. As shown, in an embodiment the finger hold 360 may further include apertures 400, which may form palm graspable surfaces in the finger hold 360. Accordingly, in some embodiments, a user of a pull-up bar assembly including the finger hold 360 may exercise by hanging from his fingers in the grooves 370 or 380 or ridges 390 of the finger hold 360 (or grasp the apertures 400 with his palms), and then move his fingers among the grooves 370 or 380, ridges 390, and apertures 400 formed on the finger hold 360, either while hanging, or while conducting a pull-up.

Although this disclosure describes in detail what is currently considered to be the most practical and preferred embodiments, it is to be understood that such detail is solely for the purpose of illustration, and that the scope of protection sought is not limited to the disclosed embodiments, but, on the contrary, is intended to cover modifications and equivalent arrangements that are within the spirit and scope of the appended claims. For example, it is to be understood that, to the extent possible, one or more features of any embodiment can be combined with one or more features of any other embodiment.

What is claimed is:

1. An exercise apparatus comprising:

a doorway engaging portion configured to releasably secure the exercise apparatus in a doorway and distribute a weight of a user of the exercise apparatus through a frame of the doorway, the doorway engaging portion comprising:

a transverse bar configured to extend across the doorway engaging portion, the transverse bar further configured to provide support grips for palm graspable engagement by the user;

a support structure secured to the transverse bar;

a finger hold mounted to the support structure, the finger hold comprising a ridge or groove shaped and sized to receive the fingertips of the user;

wherein when the doorway engaging portion is releasably securing the exercise apparatus in the doorway, the user may insert the fingertips around the ridge or into the groove of the finger hold, and perform an exercise by supporting an entirety of the weight of the user through the frame of the doorway via the finger hold.

2. The exercise apparatus of claim 1, wherein the doorway engaging portion comprises a lintel engaging portion configured to rest on a lintel of a door casing of the doorway.

3. The exercise apparatus of claim 2, wherein the doorway engaging portion comprises a support bar configured to extend across the doorway and contact side portions of the door casing.

4. The exercise apparatus of claim 1, wherein the support structure and the finger hold each comprise an aperture configured to receive a fastener therein, such that the fastener extends through the aperture in the support structure and into the aperture in the finger hold to secure the finger hold to the support structure.

5. The exercise apparatus of claim 4, wherein the aperture in the finger hold extends through the finger hold, and wherein the fastener extends through the finger hold.

6. The exercise apparatus of claim 4, wherein the fastener is configured for manual adjustment by hand.

7. The exercise apparatus of claim 4, wherein the support structure and the finger hold each comprise one or more additional apertures configured to receive one or more additional fasteners therein to further secure the finger hold to the support structure.

8. The exercise apparatus of claim 1, further comprising a support bar configured to prevent bending of the support structure when the user is performing the exercise by supporting the entirety of the weight of the user through the frame of the doorway via the finger hold.

9. The exercise apparatus of claim 1, wherein the finger hold comprises one or more of fiberglass, urethane, resin, metal, wood, rock, and plastic.

10. The exercise apparatus of claim 1, wherein the doorway engaging portion comprises one or more of metal, wood, hard plastic, and composite materials.

11. The exercise apparatus of claim 1, further comprising an additional finger hold mounted to the doorway engaging portion.

12. The exercise apparatus of claim 1, wherein the finger hold comprises an additional ridge or groove shaped and sized to receive the fingertips of the user.

13. The exercise apparatus of claim 1, wherein the finger hold is shaped and configured such that the ridge or groove does not permit the entirety of the users fingers to be inserted therein.

14. The exercise apparatus of claim 1, wherein the support bar is configured to provide support grips for palm graspable engagement by the user.

15. The exercise apparatus of claim 14, wherein the support grips are wrapped in a grip material.

16. The exercise apparatus of claim 15, wherein the grip material comprises one or more of a high friction material, a spongy material, rubber, felt, cloth, and plastic.

17. The exercise apparatus of claim 14, wherein the support grips have a tubular configuration.

18. The exercise apparatus of claim 3, wherein the door engaging portion further comprises:

side bars configured to extend away from the lintel engaging portion and the support bar.

19. The exercise apparatus of claim 18, wherein the door engaging portion further comprises:

a finger hold support bar configured to extend outward from the side bars to further secure the support structure.

20. The exercise apparatus of claim 19, wherein the support structure is positioned between the support bar and the finger hold support bar.

21. The exercise apparatus of claim 1, wherein the finger hold is mounted to the support structure via a hand adjustable turnscrew, wherein the turnscrew may be removed by hand to allow for removal and replacement of the finger hold.

22. The exercise apparatus of claim 1, wherein the support structure is a support plate.

23. A method of exercising using an exercise device, the exercise device comprising:

a doorway engaging portion configured to releasably secure the exercise apparatus in a doorway and distribute a weight of a user of the exercise apparatus through a frame of the doorway, the doorway engaging portion comprising:

a transverse bar configured to extend across the doorway engaging portion, the transverse bar further configured to provide support grips for palm graspable engagement by the user; and a support structure secured to the transverse bar;

and a finger hold mounted to the support structure, the finger hold comprising a ridge or groove shaped and sized to receive the fingertips of the user, the method comprising:

supporting the exercise apparatus in the doorway via the doorway engaging portion;

inserting the fingertips of the user around the ridge or into the groove of the finger hold; and supporting an entirety of the weight of the user through the finger hold to exercise an arm of the user.

24. The method of claim 23, wherein the finger hold is shaped and configured such that the ridge or groove does not permit the entirety of the users fingers to be inserted therein.

* * * * *